US010479071B2

(12) United States Patent
Paita et al.

(10) Patent No.: US 10,479,071 B2
(45) Date of Patent: Nov. 19, 2019

(54) DECORATION METHOD, CONTROL SYSTEM AND DECORATION MACHINE

(71) Applicant: Illinois Tool Works Inc., Glenview, IL (US)

(72) Inventors: Marco Paita, Oyonnax (FR); Tiziano Lastrucci, Florence (IT); Arnaud Villeneuve, Oyonnax (FR); Florent Demange, Montreal la Cluse (FR)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 15/388,360

(22) PCT Filed: Jul. 24, 2015

(86) PCT No.: PCT/US2015/042027
§ 371 (c)(1),
(2) Date: Dec. 22, 2016

(87) PCT Pub. No.: WO2016/014959
PCT Pub. Date: Jan. 28, 2016

(65) Prior Publication Data

US 2017/0266949 A1 Sep. 21, 2017

(30) Foreign Application Priority Data

Jul. 25, 2014 (FR) ..... 14 57214

(51) Int. Cl.
*B41F 16/00* (2006.01)
*B41F 17/00* (2006.01)
*B41F 17/18* (2006.01)

(52) U.S. Cl.
CPC ..... *B41F 16/0026* (2013.01); *B41F 17/001* (2013.01); *B41F 17/18* (2013.01)

(58) Field of Classification Search
CPC ..... B41F 16/0086; B41F 16/0026
(Continued)

(56) References Cited

U.S. PATENT DOCUMENTS 5,327,826 A * 7/1994 Rodi ..... B41F 13/12 101/181
6,413,617 B1 * 7/2002 Schlier ..... B42D 15/045 40/124.01

(Continued)

FOREIGN PATENT DOCUMENTS

EP 1769916 A2 4/2007
ES 2399283 T3 3/2013

(Continued)

OTHER PUBLICATIONS

International Searching Authority, International Search Report for PCT Application No. PCT/US2015/042027, dated Oct. 28, 2015, 42 pages.

*Primary Examiner* — Anthony H Nguyen
(74) *Attorney, Agent, or Firm* — Christopher R. Carroll; The Small Patent Law Group LLC

(57) ABSTRACT

The present invention relates to a decoration method, for applying a new décor (170) on a surface (2) of an object (1) including an existing décor (120), characterized in that the method comprises the following successive steps: a step a) for measuring at least two identification points (120*a*, 120*b*, 120*f*) of the existing décor (120) applied on the surface (2) of the object (1); a step b) for dynamic correction of localization points (170*a*, 170*b*, 170*f*) of the new décor (170) to be applied on the surface (2) of the object (1), using the identification points (120*a*, 120*b*, 120*f*) measured during the measuring step a); and a step c) for application of the new décor (170) on the surface (2) of the object (1), by using the localization points (170*a*, 170*b*, 170*f*) determined in the (Continued)

dynamic correction step b). The invention also relates to a control system and a decoration machine comprising such a control system.

17 Claims, 6 Drawing Sheets

(58) Field of Classification Search
USPC ..... 101/485, 34
See application file for complete search history.

(56) References Cited

U.S. PATENT DOCUMENTS

| | | | | |
|---|---|---|---|---|
| 8,893,418 | B1 * | 11/2014 | Yochum | A41D 27/08 2/244 |
| 2006/0196381 | A1 * | 9/2006 | Mikkelsen | B26F 1/3813 101/485 |
| 2006/0201368 | A1 * | 9/2006 | Kot | B41F 13/14 101/485 |
| 2007/0051265 | A1 * | 3/2007 | Schultze | B41F 33/0081 101/485 |

FOREIGN PATENT DOCUMENTS

| | | | |
|---|---|---|---|
| FR | 2676129 | A1 | 11/1992 |
| FR | 2891194 | A1 | 3/2007 |
| WO | 2016014959 | A1 | 1/2016 |

* cited by examiner

DECORATION METHOD, CONTROL SYSTEM AND DECORATION MACHINE

The present invention relates to a decoration method, for applying a new décor on a surface of an object including an existing décor. The invention also relates to a control system configured to carry out such a decoration method, and to a decoration machine comprising such a control system.

In the field of the decoration of objects, it is known to apply a new décor in the vicinity of a décor already existing on the surface of an object. For example, the new décor is applied on the object parallel to the existing décor. A detection device, for example a photoelectric cell, a linear camera or a matrix camera, is provided to measure a starting point of the existing décor, prior to the application of the new décor on the object. This method is generally satisfactory if the existing décor has a continuous section with a well-defined length and width, but not if this décor has a plurality of sections with variable lengths with respect to one another, or even a single section of variable width.

Some decoration methods, such as ink printing, involve driving the object in rotation about its central axis in order to mark the developed external surface thereof. The décor realized in practice is then likely to have a different printing length than the theoretical décor. The problem is accentuated when the object is cylindrical and/or has large dimensions, but also depending on the dimensional tolerances of the décor, which is not perfectly regular.

In practice, it is known to detect and record the position of a starting point of the existing décor, which will serve as a reference for positioning the starting point of the new décor to be realized, aligned with the starting point of the existing décor or with a desired offset. The length of the new décor is indexed to the theoretical length of the existing décor. The starting point of the new décor is then correctly positioned with respect to the existing décor, but not the rest of the new décor, thereby impairing the appearance of the object. This problem is frequently encountered in applications for cosmetics, stoppers, alcohol and spirit bottles, without a satisfactory solution to date. The freedom of the designer is limited during the design of the new décor. Visible defects are likely to bring about costly rejects in production.

The aim of the present invention is to propose an improved decoration method that remedies the abovementioned drawbacks.

To this end, the subject of the invention is a decoration method, for applying a new décor on a surface of an object including an existing décor. The decoration method is characterized in that it comprises the following successive steps:

a) a step for measuring at least two identification points of the existing décor applied on the surface of the object;
b) a step for dynamic correction of localization points of the new décor to be applied on the surface of the object, using information relating to a theoretical décor and the identification points measured during the measuring step a); and
c) a step for application of the new décor on the surface of the object, by using the localization points determined in the dynamic correction step b).

Thus, the invention makes it possible to position the new décor in a manner corresponding to the existing décor with improved precision. By virtue of the measurement of at least two identification points, the dynamic correction is more effective. The method can be repeated for several objects of a single set, for example a set of bottles. Moreover, the method can be repeated for the application a succession of décors to one and the same object, for example three or four successive décors that need to be positioned with precision with respect to one another.

According to further advantageous features of the method according to the invention, taken in isolation or in combination:

The identification points comprise at least one starting point and/or one ending point of the existing décor, preferably at least the starting point and the ending point of the existing décor.

The existing décor and the new décor comprise neighboring borders that are rectilinear and substantially parallel projected in a plane, the identification points are measured only along a first direction in the measuring step a), and a substantially constant gap between the existing décor and the new décor, defined along a second direction orthogonal to the first direction, is obtained by closed-loop control of a decoration device in the application step c).

The identification points are measured along two directions in the measuring step a).

The existing décor and the new décor comprise neighboring borders that are non-rectilinear and/or non-parallel and the identification points are measured along the border of the existing decoration in the measuring step a).

The existing décor and the new décor comprise several discontinuous sections.

The identification points comprise at least one starting point and/or one ending point for each of the discontinuous sections of the existing décor.

The invention also relates to a control system, configured to carry out a decoration method as mentioned above, characterized in that the control system comprises a detection device suitable for measuring at least two identification points of the existing décor, so as to perform dynamic correction of the localization points of the new décor to be applied on the surface of the object, by using the identification points.

Preferably, the detection device is a linear camera.

A further subject of the invention is a decoration machine, comprising a control system as mentioned above. Preferably, the machine is intended to carry out hot stamping. The machine may comprise several stations, including at least one measuring station equipped with a detection device and a decoration station equipped with a decoration device. Alternatively, the machine may comprise a single station, equipped with a detection device and a decoration device. By way of nonlimiting example, the detection device is a linear camera and the decoration device is a hot stamping head comprising a die.

The invention will be better understood from reading the following description, given solely by way of nonlimiting example and with reference to the appended drawings, which are schematic depictions, in which.

FIGS. 1 to 12 partially and schematically show a three-dimensional object, for example a glass bottle 1, having a cylindrical external surface 2, depicted as a rectangular planar developed surface. The surface 2 has a length L2 defined between two longitudinal ends 2A and 2B along a longitudinal decoration application direction D1. When the surface 2 is not projected, the ends 2A and 2B are coincident. A direction D2 orthogonal to the direction D1 is defined. The direction D2 extends parallel to the central axis of the bottle 1, while the direction D1 is orthoradial to the central axis of the bottle 1.

In the examples in FIGS. 1 to 6, the surface 2 receives theoretical décors 10 and 10', or practical décors 20, 30, 40 and/or 50. In each of FIGS. 1 to 6, the existing décor 10 or 20 and the new décor 10', 30, 40 or 50 extend in parallel alongside one another on the surface 2 and comprise several discontinuous sections, requiring precise relative positioning. The constituent elements that are analogous to the décor 10 receive apostrophes for the décor 10', while they comprise numerical references increased by ten for the décor 20, by twenty for the décor 30, by thirty for the décor 40 and by forty for the décor 50. The dimensional divergences are exaggerated in FIGS. 3 to 6 compared with FIGS. 1 and 2 in order to make it easier to understand the invention.

Figure 1:
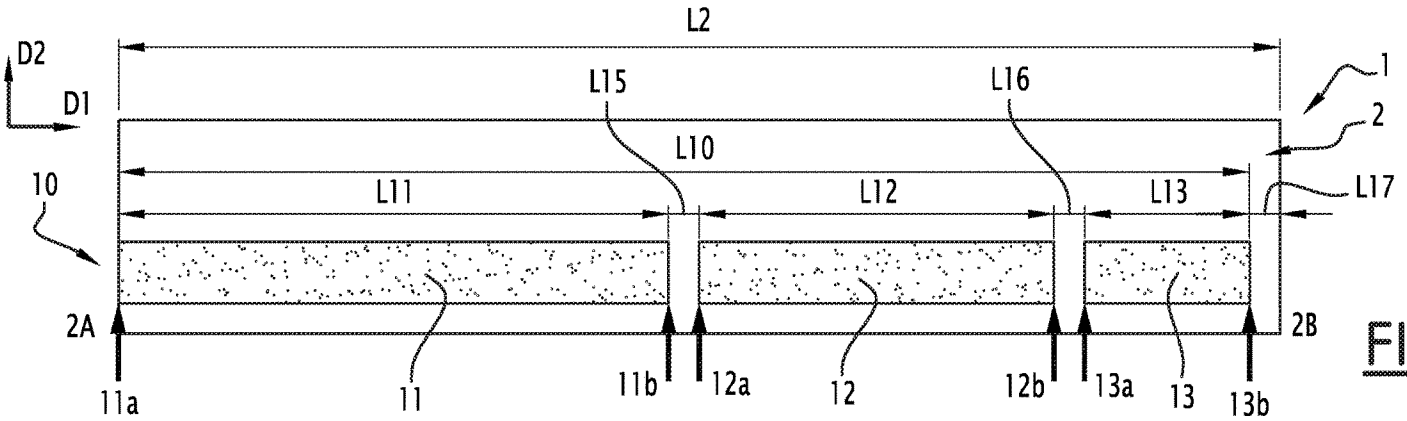
FIG. 1 shows a first theoretical décor applied on an object.

In FIG. 1, the surface 2 has a first theoretical décor 10 comprising three longitudinal sections 11, 12 and 13. The section 11 has a length L11 defined between two points 11*a* and 11*b*. The section 12 has a length L12 defined between two points 12*a* and 12*b*. The section 13 has a length L13 defined between two points 13*a* and 13*b*. The section 11 starts at the end 2A, in other words the point 11*a* is situated at the end 2A. The sections 11, 12 and 13 are discontinuous. A space of length L15 is defined between the sections 11 and 12, more precisely between the points 11*b* and 12*a*. A space of length L16 is defined between the sections 12 and 13, more precisely between the points 12*b* and 13*a*. A space of length L17 is defined between the section 13 and the end 102, more precisely between the point 13*b* and the end 2B. The décor 10 has a length L10 equal to the sum of the lengths L11, L12, L13, L15 and L16.

Figure 2:
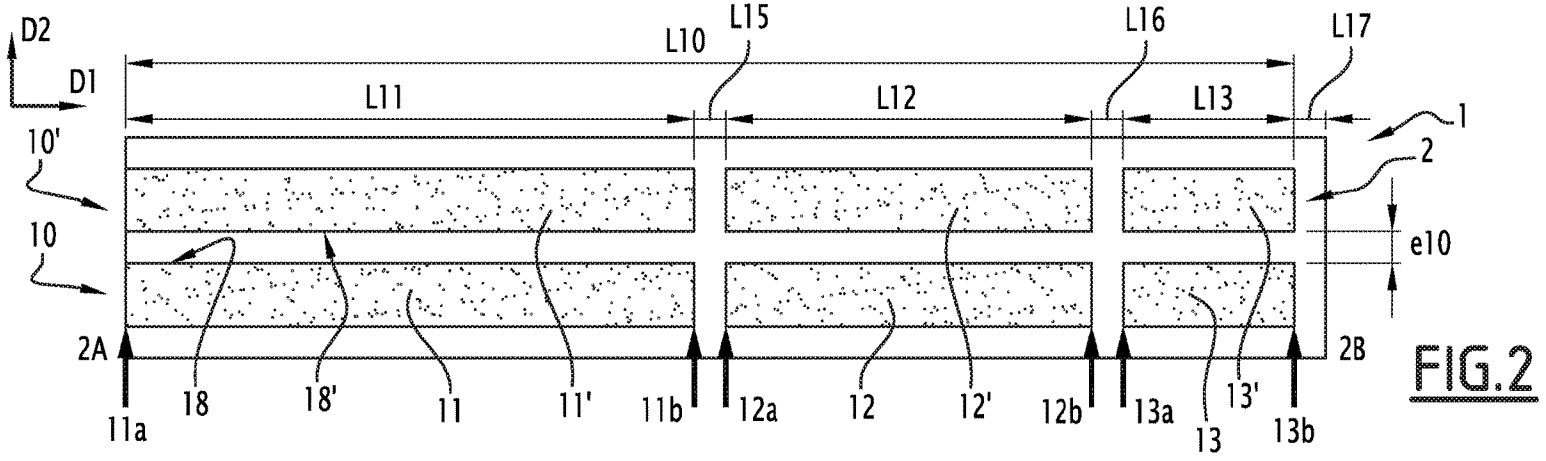
FIG. 2 shows the first theoretical décor and a second theoretical décor applied in parallel on the object in FIG. 1.

In FIG. 2, the surface 2 has a second theoretical décor 10' applied next to the first theoretical décor 10. The theoretical décors 10 and 10' are aligned perfectly along the directions D1 and D2. In particular, the sections 11', 12' and 13' each have the same lengths L11, L12 and L13 as the sections 11, 12 and 13 along the direction D1, while their starting points and ending points are aligned along the direction D2. The décors 10 and 10' comprise neighboring borders, 18 and 18', respectively, which are rectilinear and substantially parallel in projection in the plane of the developed surface 2. A constant gap e10 is defined along the direction D2 between the décors 10 and 10', more precisely between the borders 18 and 18'. This constant gap e10 is obtained by closed-loop control of a decoration device, for example a hot stamping head, when the practical décor corresponding to the theoretical décor 10' is applied to the surface 2 of the bottle 1.

In FIGS. 3 to 6, the surface 2 receives practical decorations 20, 30, 40 and 50. Each practical décor is imperfect and does not correspond exactly to the theoretical décor 10 or 10', in particular on account of the dimensional tolerances inherent to each decoration method that is likely to be employed. In addition, the practical décors are likely to vary from one bottle 1 to another in the same set based on the same theoretical décors 10 or 10'. The décors 40 and 50 realized by implementing the invention are more precise than the décor 30, as explained in detail below.

Figure 3:
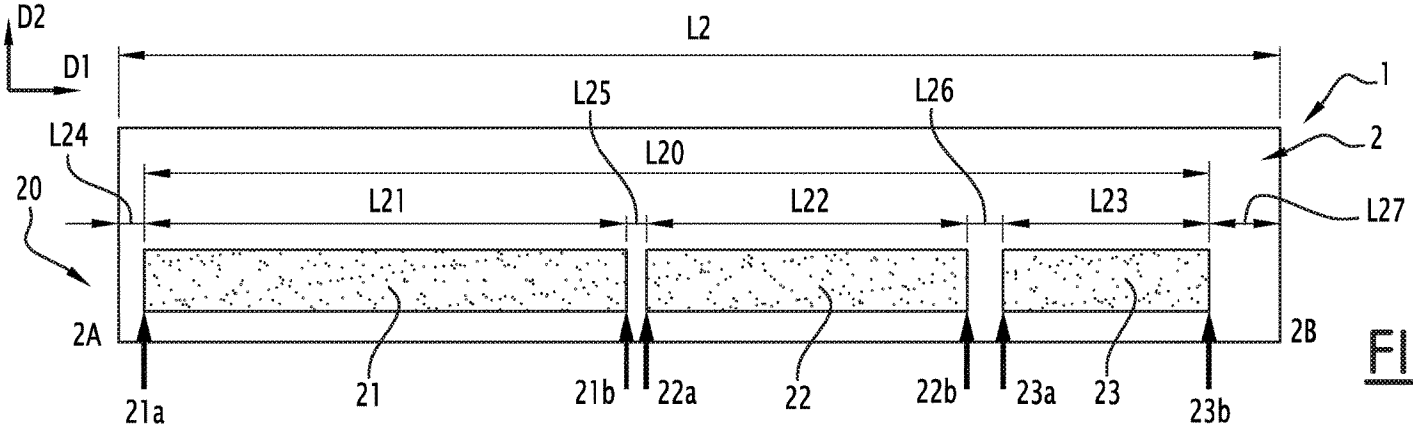
FIG. 3 shows a first practical décor applied on the object in FIG. 1, having a number of divergences from the first theoretical décor.

In FIG. 3, the surface 2 receives the first practical décor 20 that is intended to correspond to the theoretical décor 10 and comprises three longitudinal sections 21, 22 and 23. The section 21 has a length L21 defined between two points 21*a* and 21*b*. The section 22 has a length L22 defined between two points 22*a* and 22*b*. The section 23 has a length L23 defined between two points 23*a* and 23*b*. A space of length L24 is defined between the end 2A and the section 21, more precisely between the end 2A and the point 22*a*. A space of length L25 is defined between the sections 21 and 22, more precisely between the points 21*b* and 22*a*. A space of length L26 is defined between the sections 22 and 23, more precisely between the points 22*b* and 23*a*. A space of length L27 is defined between the section 23 and the end 2B, more precisely between the point 23*b* and the end 2B. The décor 20 has a length L20 equal to the sum of the lengths L21, L22, L23, L25 and L26.

The practical décor 20 is imperfect and does not correspond exactly to the theoretical décor 10, in particular on account of the dimensional tolerances inherent to each decoration method likely to be employed. In FIG. 3, the section 21 does not start at the end 2A, and so the point 21*a* is separated from the end 2A by the length L24. Moreover, the length L20 is not equal to the length L10, and so the sections 21, 22 and 23 of the practical décor are offset with respect to the sections 11, 12 and 13 of the theoretical décor. The points 21*b*, 22*a*, 22*b*, 23*a* and 23*b* do not coincide with the points 11*b*, 12*a*, 12*b*, 13*a* and 13*b*, respectively. The lengths L21, L22, L23, L25, L26 and L27 are different than the lengths L11, L12, L13, L15, L16 and L17, respectively. In the example in FIG. 3, the lengths L21, L22 and L25 are less than the lengths L11, L12 and L15, respectively, while the lengths L23, L26 and L27 are greater than the lengths L13, L16 and L17, respectively.

In spite of the slight dimensional divergences between the theoretical décor 10 and the practical décor 20, the visual appearance of the surface 2 including the décor 20 is satisfactory overall.

Secondly, following application of the décor 20 on the surface 2, a new décor is applied next to the existing décor 20.

To this end, the decoration machine comprises a control unit designed to receive and process, on the one hand, information relating to the theoretical décors 10 and 10' and, on the other hand, information relating to the practical décor 20 that is stored in a control system. The control system may comprise various types of detection device, for example a photoelectric cell, a matrix camera or preferably a linear camera. The control unit is also designed to control the movement of the bottle 1, more precisely the rotation of the bottle 1 about its central axis, and also the movement of the decoration device, which is for example a hot stamping head comprising a die.

Figure 4:
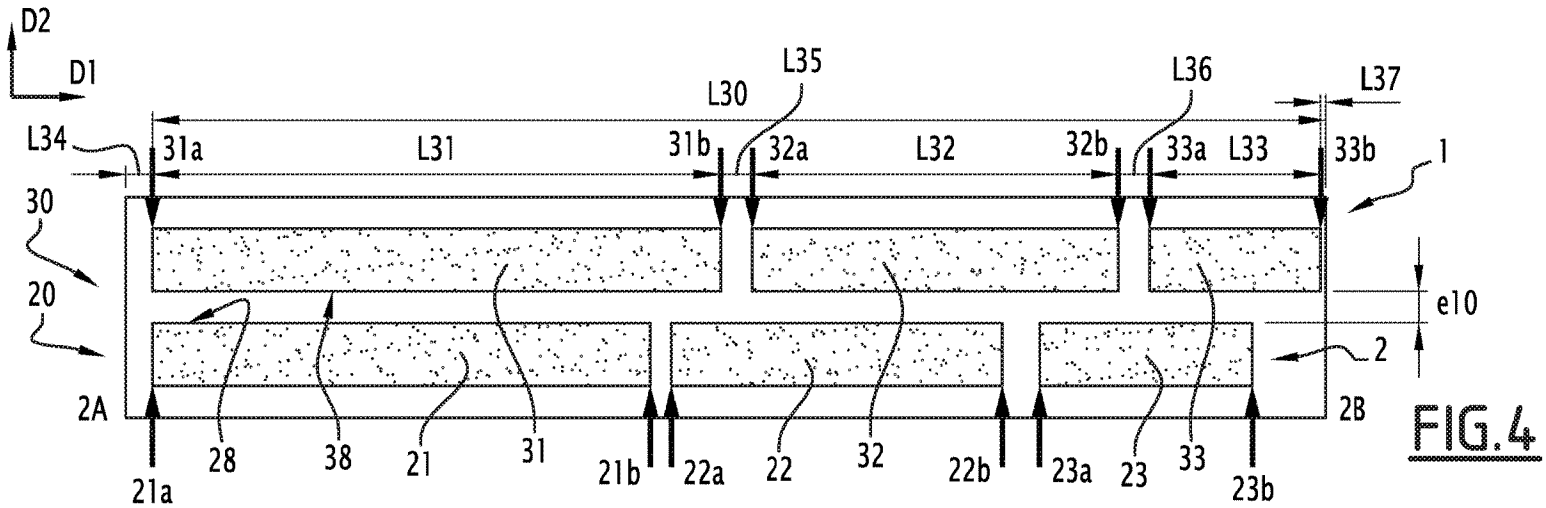
FIG. 4 shows a second practical décor not in accordance with the invention, applied in parallel to the first practical décor on the object in FIG. 2.
Figure 5:
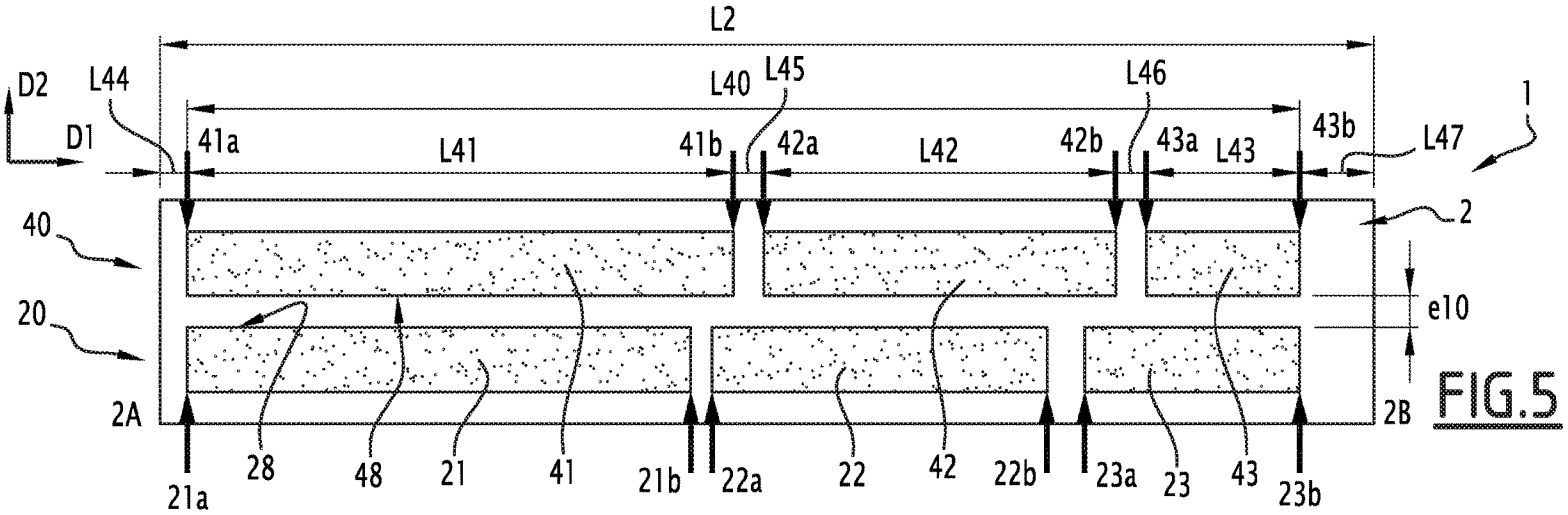
FIG. 5 shows a second practical décor in accordance with a first embodiment of the invention, applied in parallel to the first practical décor on the object in FIG. 2.
Figure 6:
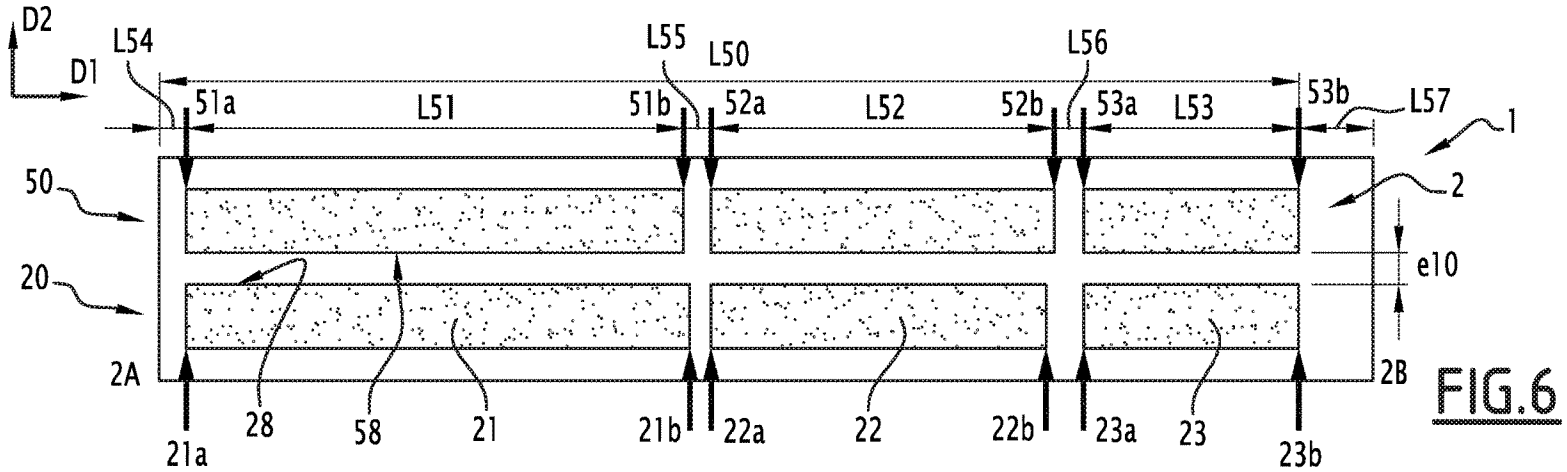
FIG. 6 shows a second practical décor in accordance with a second embodiment of the invention, applied in parallel to the first practical décor on the object in FIG. 2.

FIG. 4 illustrates a known decoration method, not in accordance with the invention, while FIGS. 5 and 6 illustrate two embodiments of a decoration method in accordance with the invention.

In FIG. 4, the surface 2 including the first décor 20 receives the second practical décor 30 realized, on the one hand, on the basis of the information relating to the second theoretical décor 10', by bringing the lengths L30, L31, L32, L33, L35 and L36 into coincidence with the lengths L10', L11', L12', L13', L15' and L16', respectively, along the direction D1 and, on the other hand, on the basis of the information relating to the first practical décor 20 which is provided by the control system, by bringing the starting point 31*a* of the décor 30 into coincidence with the starting point 21*a* of the décor 20 along the direction D1, with the gap e10 formed between the borders 28 and 38 of the décors 20 and 30 along a direction D2. In other words, the coordinates of the starting point 31*a* of the section 31 coincide with the coordinates of the starting point 21*a* of the section 21 along the direction D1. By virtue of the control system, the length L34 is equal to the length L24. By contrast, the length L30 corresponds to the theoretical length L10 but not to the practical length L20. The points 31*b*, 32*a*, 32*b*, 33*a* and 33*b* do not coincide with the points 21*b*, 22*a*, 22*b*, 23*a* and 23*b*, respectively, along the direction D1. The lengths L31, L32, L33, L35 and L36 are equal to the lengths L11, L12, L13, L15 and L16, respectively, but are different than the lengths L21, L22, L23, L25 and L26, respectively.

Under these conditions, the décor 30 is not positioned correctly with respect to the décor 20 along a direction D1. The visual appearance of the surface 2 including the décors 20 and 30 is not satisfactory.

In FIG. 5, the surface 2 including the first décor 20 receives the second practical décor 40 realized, on the one hand, on the basis of the information relating to the second theoretical décor 10', in particular the lengths L10, L11, L12, L13, L15 and L16 and, on the other hand, on the basis of the information relating to the first practical décor 20 which is provided by the control system, by bringing the starting point 41*a* of the décor 14 into coincidence with the starting point 21*a* of the décor 20 and the ending point 43*b* of the décor 14 into coincidence with the ending point 23*b* of the décor 20 along the direction D1, with the gap e10 formed between the borders 28 and 48 of the décors 20 and 40 along the direction D2. In other words, the coordinates of the starting point 41*a* of the section 41 coincide with the coordinates of the starting point 21*a* of the section 21 and the coordinates of the ending point 43*b* of the section 43 coincide with the coordinates of the ending point 23*b* of the section 23 along the direction D1. By virtue of the control system, the length L40 is equal to the length L20, the length L44 is equal to the length L24 and the length L47 is equal to the length L27. By contrast, the points 41*b*, 42*a*, 42*b* and 43*a* do not coincide with the points 21*b*, 22*a*, 22*b* and 23*a*, respectively, along the direction D1. The lengths L41, L42, L43, L45 and L46 are equal to the lengths L11, L12, L13, L15 and L16, respectively, multiplied by a coefficient L40/L10, but are different than the lengths L21, L22, L23, L25 and L26, respectively.

Thus, even if the décor 40 is not positioned perfectly on the surface 2 with respect to the décor 20, the result is all the same more satisfactory than in the case of the décor 30.

In FIG. 6, the surface 2 including the first décor 20 receives the second practical décor 50 realized, on the one hand, on the basis of the information relating to the second theoretical décor 10', in particular the lengths L10, L11, L12, L13, L15 and L16 and, on the other hand, on the basis of the information relating to the first practical décor 20 which is provided by the control system, by bringing the starting point 51*c* of the décor 50 into coincidence with the starting point 21*a* of the décor 20, the starting point 52*a* of the section 52 into coincidence with the starting point 22*a* of the section 22, the starting point 53*a* of the section 53 into coincidence with the starting point 23*a* of the section 23 and the ending point 53*b* of the décor 50 into coincidence with the ending point 23*b* of the décor 20 along the direction D1, with the gap e10 formed between the borders 28 and 58 of the décors 20 and 50 along the direction D2. In other words, the coordinates of each starting point 51*a*, 52*a* and 53*a* of the sections 51, 52 and 53 coincide with the coordinates of each starting point 21*a*, 22*a* and 23*a*, respectively, of the sections 21, 22 and 23, and the coordinates of the ending point 53*b* of the section 53 coincide with the coordinates of the ending point 23*b* of the section 23 along the direction D1. By virtue of the control system, the length L50 is equal to the length L20, the length L54 is equal to the length L24 and the length L57 is equal to the length L27. By contrast, the points 51*b* and 52*b* do not coincide with the points 21*b* and 22*b*, respectively. The lengths L51, L52 and L53 are equal to the lengths L11, L12 and L13, respectively, multiplied by a coefficient L50/L10, but are different than the lengths L21, L22 and L23, respectively.

Thus, even if the décor 50 is not positioned perfectly on the surface 2 with respect to the décor 20, the result is all the same more satisfactory than in the case of the décor 40.

In the examples in FIGS. 7 to 12, the surface 2 receives theoretical décors 110 and 110', or practical décors 120, 130, 140, 150, 160 and/or 170. In each of FIGS. 7 to 12, the existing décor 110 or 120 and the new décor 110', 130, 140, 150, 160 or 170 comprise borders with a wavy shape, requiring precise relative positioning. The constituent elements that are analogous to the décor 110 receive apostrophes for the décor 110', while they comprise numerical references increased by ten for the décor 120, by twenty for the décor 130, by thirty for the décor 140, by forty for the décor 150, by fifty for the décor 160 and by sixty for the décor 170. The dimensional divergences are exaggerated in FIGS. 8 to 12 compared with FIG. 7 in order to make it easier to understand the invention.

Figure 7:
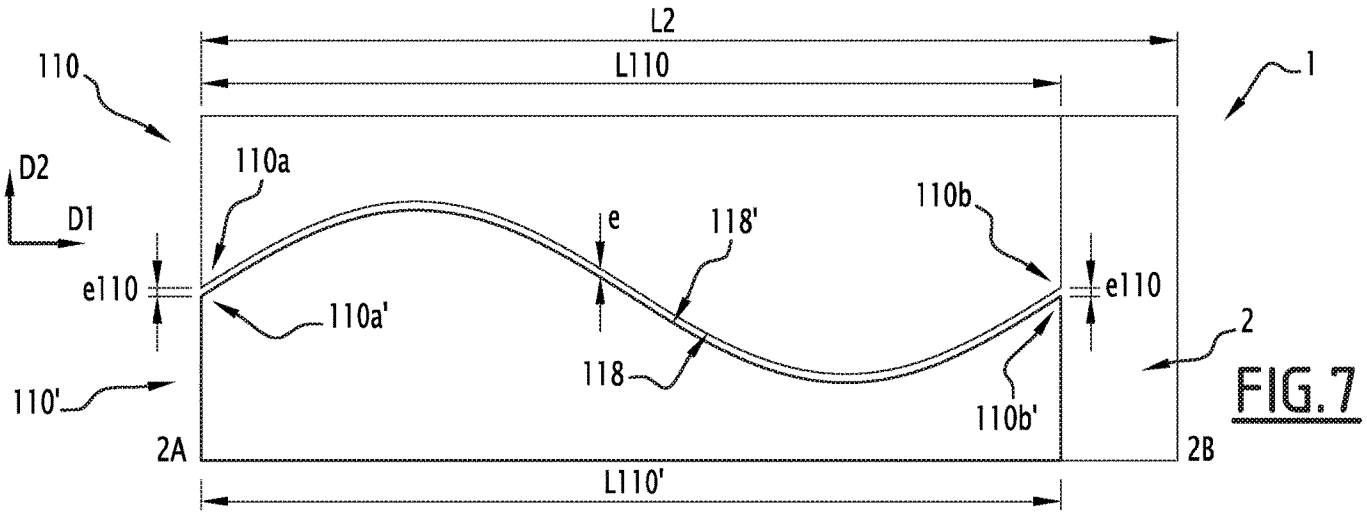
FIG. 7 shows a first theoretical décor and a second theoretical décor applied in parallel on an object, having different patterns than the décors in FIGS. 1 to 6.

In FIG. 7, the surface 2 includes a first theoretical décor 110 and a second theoretical décor 110' applied next to the first theoretical décor 110, each comprising a single longitudinal section and an undulating border 118 and 118', respectively. The décor 110 has a length L110 defined between two points 110*a* and 110*b* along the direction D1. The décor 110' has a length L110' defined between two points 110*a'* and 110*b'* along the direction D1. The points 110*a* and 110*b* are situated on the border 118, while the points 110*a'* and 110*b'* are situated on the border 118'. The décors 110 and 110' start at the end 2A, in other words the points 110*a* and 110*a'* are situated at the end 2A. The theoretical décors 110 and 110' are perfectly aligned along the directions D1 and D2. A constant gap e110 is defined along the direction D2 between the décors 110 and 110', more precisely between the borders 118 and 118'. The wavy shape of the practical décors corresponding to the theoretical décors 110 and 110' may be obtained by virtue of the configuration of the decoration device, which is for example a stamping head comprising a die. The first practical décor is applied by a first die, and then the second practical décor is applied by a second die.

In FIGS. 8 to 12, the surface 2 receives practical decorations 120, 130, 140, 150, 160 and 170. Each practical décor is imperfect and does not correspond exactly to the theoretical décor 110 or 110', in particular on account of the dimensional tolerances inherent to each decoration method that is likely to be employed. In addition, the practical décors are likely to vary from one bottle 1 to another in the same set based on the same theoretical décors 110 or 110'. Following application of the décor 120 on the surface 10, a new décor 130, 140, 150, 160 or 170 is applied next to the existing décor 120. The identification points are measured along the border 128 of the decoration 120, as explained in detail below. The décors 140, 150, 160 and 170 realized by implementing the invention are more precise than the décor 130.

Figure 8:
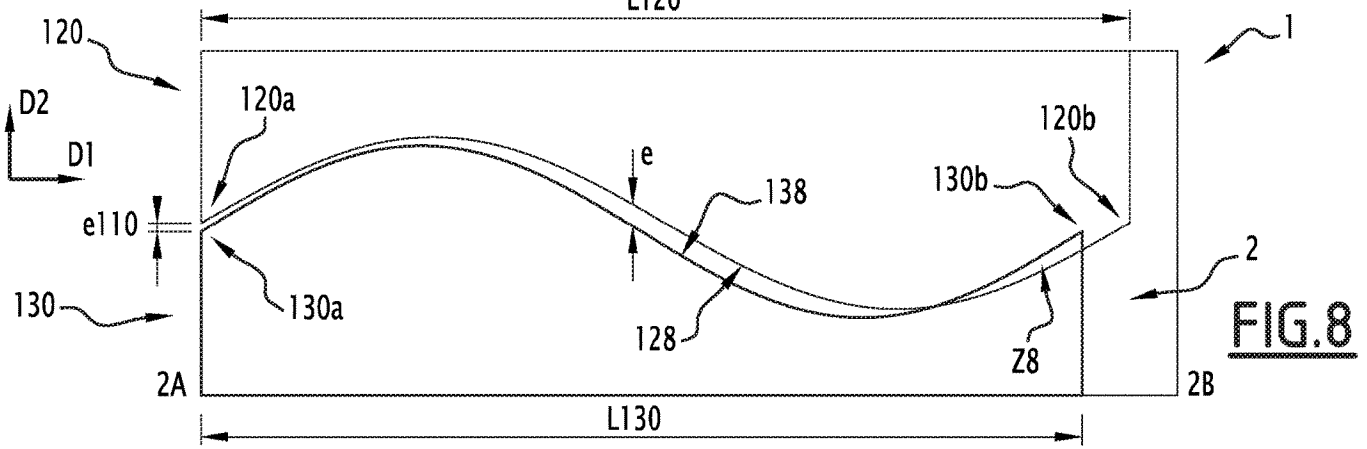
FIG. 8 shows a first practical décor and a second practical décor intended to correspond to the theoretical décors in FIG. 7.

In FIG. 8, the surface 2 receives the first practical décor 120 and the second practical décor 130 that are intended to correspond to the theoretical décors 110 and 110', respectively. The practical décors 120 and 130 are imperfect and do not correspond exactly to the theoretical décors 110 and 110'. The starting points 120*a* and 130*a* are positioned properly at the end 2A, but the ending points 120*b* and 130*b* are separated from the points 110*b* and 110*b*'. In the example shown, the point 120*b* is closer to the end 2B than the point 110*b*, while the point 130*b* is further away from the end 2B than the point 110*b*'. The gap "e" between the borders 128 and 138 is variable and does not correspond to the gap e110. An overlapping zone Z8 of the décors 120 and 130 is apparent near the end 2B. The visual appearance of the surface 2 including the décors 120 and 130 is not satisfactory.

Figure 9:
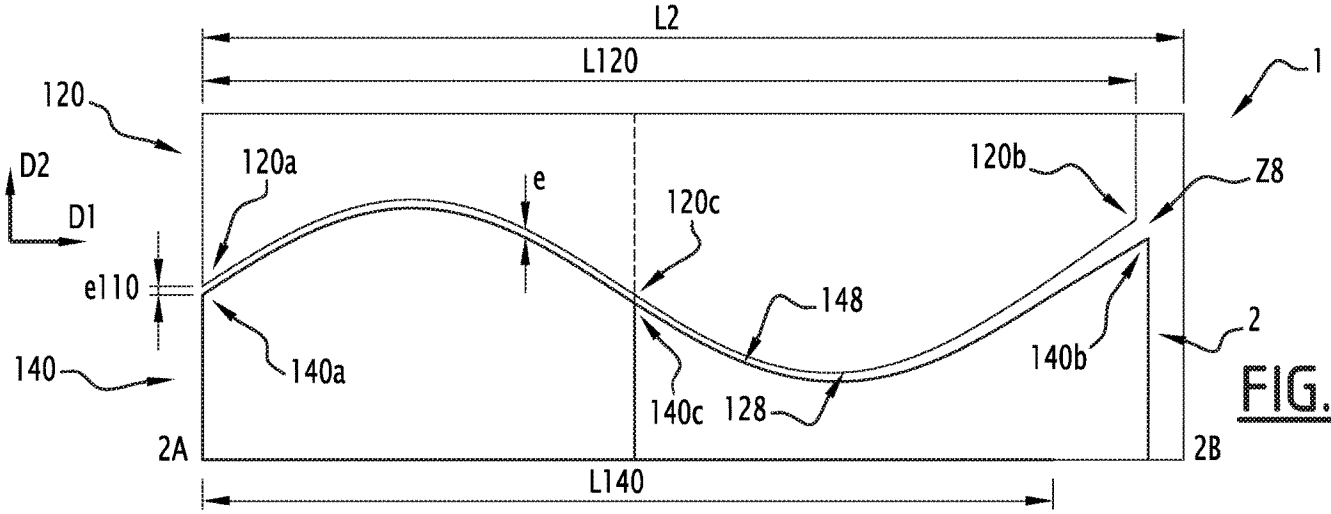
FIGS. 9 to 12 show a second practical décor in accordance with a third, a fourth, a fifth and a sixth embodiment of the invention, respectively, applied next to the first practical décor on the object in FIG. 8.

In FIG. 9, the surface 2 including the first décor 120 receives the second practical décor 140 realized, on the one hand, on the basis of the information relating to the second theoretical décor 110' and, on the other hand, on the basis of the information relating to the first practical décor 110 which is provided by the system control system, by positioning the starting point 140*a* of the décor 140 in a manner corresponding to the starting point 120*a* of the décor 120 and by positioning an intermediate point 140*c* situated on the border 148 of the décor 140 in a manner corresponding to an intermediate point 120*c* situated on the border 128 of the décor 120, along the direction D1. At the points 140*a* and 140*c*, the gap "e" between the borders 128 and 148 is equal to the reference gap e110. Between the points 140*a* and 140*c*, and between the points 140*c* and 140*b*, this gap "e" is likely to vary. In this case, the point 140*b* is offset towards the end 2B compared with the point 120*b* in the zone Z8, but this offset is less significant than for the points 120*b* and 130*b*. Thus, even if the décor 140 is not positioned perfectly on the surface 2 with respect to the décor 120, the result is all the same more satisfactory than in the case of the décor 130.

Figure 10:
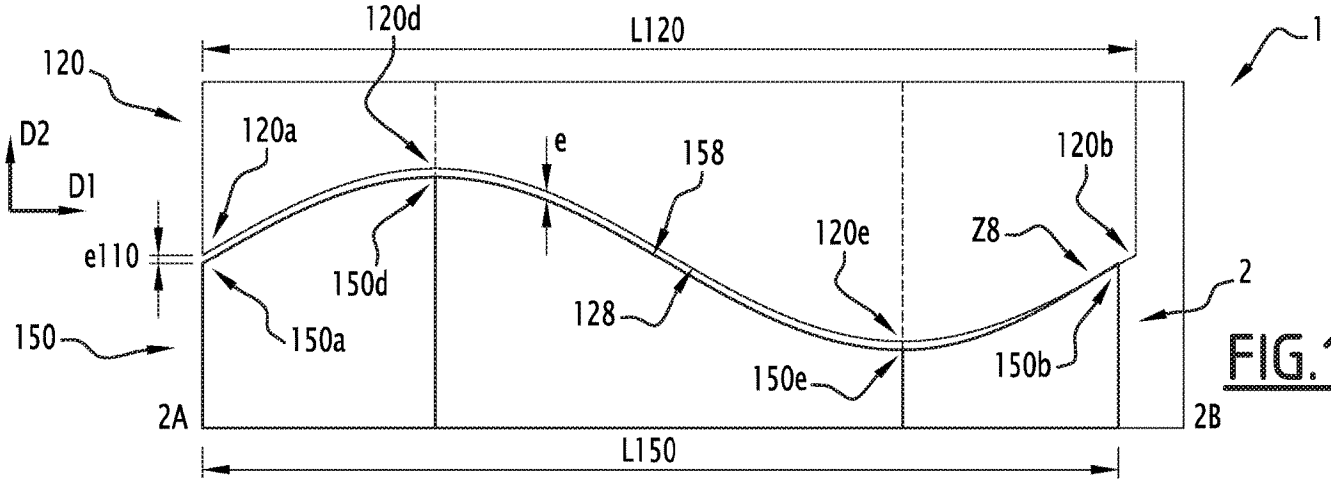

In FIG. 10, the surface 2 including the first décor 120 receives the second practical décor 150, by the starting point 150*a* of the décor 150 being positioned in a manner corresponding to the starting point 120*a* of the décor 120 and by two intermediate points 150*d* and 150*c* situated on the border 158 of the décor 150 being positioned in a manner corresponding to two intermediate points 120*d* and 120*c* situated on the border 128 of the décor 120, along the direction D1. At the points 150*a*, 150*d* and 150*c*, the gap "e" between the borders 128 and 158 is equal to the reference gap e110. Between the points 150*a* and 150*d*, between the points 150*d* and 150*e*, and between the points 150*e* and 150*b*, this gap "e" is likely to vary. In this case, the point 150*b* is offset away from the end 2B with respect to the point 120*b* in the zone Z8, but this offset is less significant than for the points 120*b* and 130*b*. Thus, even if the décor 150 is not positioned perfectly on the surface 2 with respect to the décor 120, the result is all the same more satisfactory than in the case of the décor 130.

Figure 11:
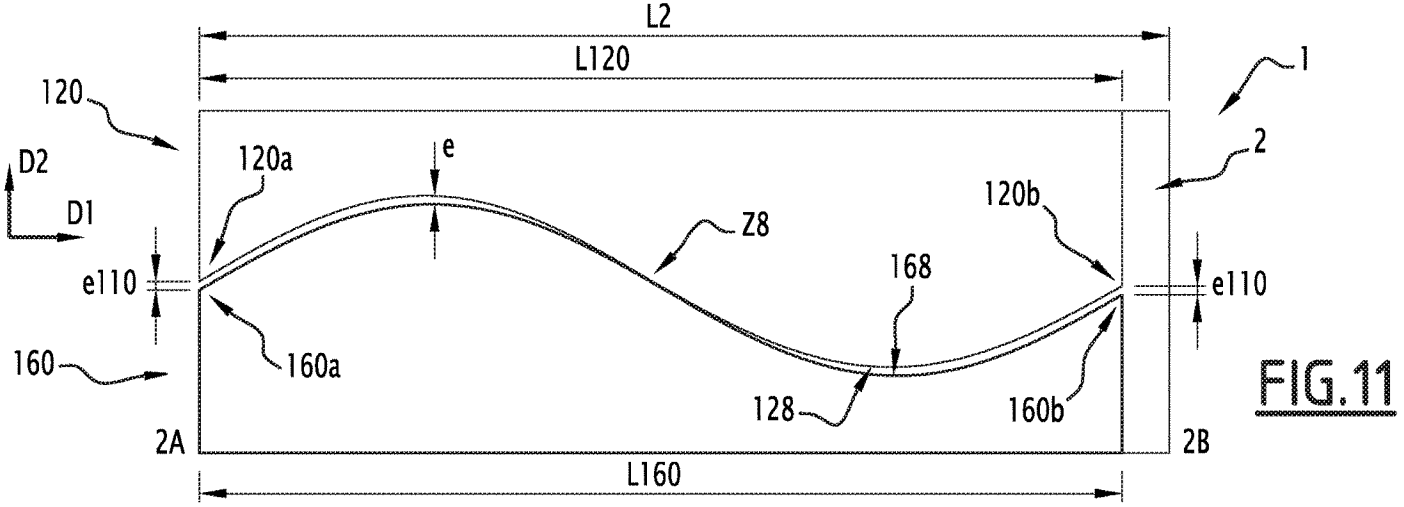

In FIG. 11, the surface 2 including the first décor 120 receives the second practical décor 160, by the starting point 160*a* of the décor 160 being positioned in a manner corresponding to the starting point 120*a* of the décor 120 and by the ending point 160*b* of the décor 160 being positioned in a manner corresponding to the ending point 120*b* of the décor 120, along the direction D1. At the points 160*a* and 160*b*, the gap "e" between the borders 128 and 168 is equal to the reference gap e110. Between the points 160*a* and 160*b*, this gap "e" is likely to vary. An overlapping zone Z8 of the décors 120 and 160 is apparent between the points 160*a* and 160*b*, but this defect is less significant than for the décors 120 and 130. Thus, even if the décor 160 is not positioned perfectly on the surface 2 with respect to the décor 120, the result is all the same more satisfactory than in the case of the décor 130.

Figure 12:
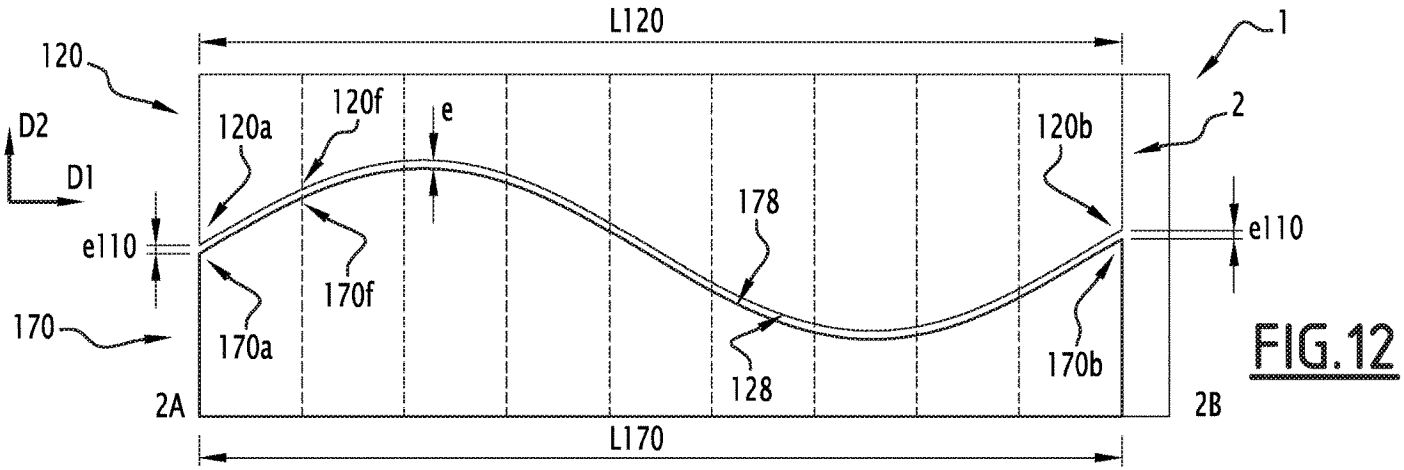

In FIG. 12, the surface 2 including the first décor 120 receives the second practical décor 170, by the starting point 170*a* of the décor 170 being positioned in a manner corresponding to the starting point 120*a* of the décor 120, by the ending point 170*b* of the décor 170 being positioned in a manner corresponding to the ending point 120*b* of the décor 120, and by eight intermediate points 170*f* and so on situated on the border 178 of the décor 170 being positioned in a manner corresponding to eight intermediate points 120*f* and so on situated on the border 128 of the décor 120, along the direction D1. At the points 170*a*, 170*b*, 170*f* and so on, the gap "e" between the borders 128 and 178 is equal to the reference gap e110. On account of the large number of intermediate identification points 120*f* and so on, the gap "e" between the borders 128 and 178 varies little over the entire surface 102. Thus, the correspondence between the décors 120 and 170 is improved compared with the décors 130, 140, 150 and 160.

In practice, the decoration method according to the invention comprises different successive steps a), b) and c) for applying the new décor 40, 50, 140, 150, 160 or 170 on the surface 2 including the existing décor 20 or 120. The method comprises a step a) for measuring at least two identification points of the existing décor 20 or 120 applied on the surface 2 of the bottle 1. Preferably, the identification points comprise at least one starting point 21*a* or 120*a* and/or one ending point 23*b* or 120*b* of the existing décor 20 or 120. In particular, the identification points may comprise the starting point and the ending point of the existing décor 20 or 120. The identification points comprise the points 21*a* and 23*b* in the example of FIG. 5, the points 21*a*, 22*a* and 23*a* in the example of FIG. 6, the points 120*a* and 120*c* in the example of FIG. 9, the points 120*a*, 120*d* and 120*e* in the example of FIG. 10, the points 120*a* and 120*b* in the example of FIG. 11 and the points 120*a*, 120*b* 120*f* and so on in the example of FIG. 12. The measuring step a) is realized by employing the control system with which the decoration machine is equipped.

Next, the method comprises a step b) for dynamic correction of localization points of the new décor 40; 50, 140; 150, 160 or 170 to be applied on the surface 2 of the bottle 1, using the identification points measured during the measuring step a). These localization points comprise the points 41*a*, 41*b*, 42*a*, 42*b*, 43*a* and 43*b* in the example of FIG. 5, the points 51*a*, 51*b*, 52*a*, 52*b*, 53*a* and 53*b* in the example of FIG. 6, the points 140*a*, 140*b* and 140*c* in the example of FIG. 9, the points 150*a*, 150*b*, 150*d* and 150*e* in the example of FIG. 10, the points 160*a* and 160*b* in the example of FIG.

11 and the points 170*a*, 170*b*, 170*f* and so on in the example of FIG. 12. Preferably, the dynamic correction step b) uses, on the one hand, information relating to the theoretical décor 10' or 110' and, on the other hand, information relating to the identification points measured during the measuring step a).

Finally, the method comprises a step c) for application of the new décor 40, 50, 140, 150, 160 or 170 on the surface 2 of the bottle 1, by using the localization points determined in the dynamic correction step b). Depending on the information processed by the control unit during the dynamic correction step b), the application step c) comprises a variation in the movement of the bottle 1, more precisely a variation in the speed of rotation of this bottle 1 about its central axis, that is to say an acceleration or a deceleration. Thus, the dynamic correction makes it possible to bring the new décor 40, 50, 140, 150, 160 or 170 better into correspondence with the existing décor 20 or 120.

In the examples of FIGS. 5 and 6, the identification points of the existing décor 20 are measured along the direction D1 only. Similarly, the localization points of each new décor 40 and 50 are determined only along the direction D1. In other words, each identification point or localization point is identified by a single coordinate in a linear reference frame defined along the direction D1.

In the examples of FIGS. 9 to 12, the identification points of the existing décor 120 are measured along the wavy border 120 along the two directions D1 and D2. Similarly, the localization points of each new décor 140, 150, 160 and 170 are determined along the direction D1 and D2. In other words, each identification point or localization point is identified by two coordinates in an orthogonal reference frame defined along the directions D1 and D2.

In the examples of FIGS. 1 to 12, the decoration does not include an overlap between the existing décor and the new décor. The gap e10 defined along the direction D2 between the décors 20 and 50 or 60 is kept substantially constant by closed-loop control of the decoration device controlled by the control unit. The gap "e" defined along the direction D2 between the décors 120 and 140, 150, 160 or 170 is also as close as possible to the reference gap e110, ideally equal to the reference gap e110.

According to the invention, the control system comprises a detection device designed to measure at least two identification points of the existing décor 20 or 120, so as to realize dynamic correction of the localization points of the new décor 40, 50, 140, 150, 160 or 171 to be applied on the surface 2 of the bottle 1, by using the identification points. Preferably, the detection device is a linear camera. The dynamic correction is realized by the control unit with which the decoration machine is equipped.

Furthermore, the decoration method, the detection system and/or the decoration machine may be different than the examples described above without departing from the scope of the invention.

In a variant that is not shown, the object 1 may be other than a bottle. For its part, the surface 2 to be decorated may have a shape other than a cylinder. Furthermore, the developed form of this surface 2 projected in a plane may be different than a rectangular surface. Depending on the shape of the object 1 and of the surface 2, the application step c) may comprise a variation in the movement of the object 1 and/or a variation in the movement of the decoration device belonging to the decoration machine.

According to another variant that is not shown, other décors then those in FIGS. 1 to 12 may be applied to the surface 2 of the bottle 1. For example, the décors may comprise several sections with wavy borders. According to another example, the décors may comprise a single section with mutually parallel borders. According to another example, the décors may comprise any type of neighboring borders that are non-rectilinear and/or non-parallel. According to another example, one of the décors or the décors may comprise graduations distributed along the surface 2.

According to one alternative, the decoration may include a partial or complete overlap between the existing décor and the new décor.

Moreover, the technical features of the various embodiments and variants described above may all, or just some, be combined with one another. Thus, the decoration method and the detection system can be adapted in terms of cost, ergonomics and performance.

The invention claimed is:

1. A decoration method for applying a new décor on a surface of an object including an existing décor, the method comprising:

measuring at least two identification points of the existing décor applied on the surface of the object;

identifying localization points to be used for applying the new décor on the surface of the object, the localization points identified using information relating to a theoretical décor and the at least two identification points that are measured, wherein the theoretical décor represents an intended placement of the new décor on the surface of the object; and applying the new décor on the surface of the object using the localization points, wherein the existing décor and the new décor comprise neighboring borders that are rectilinear and substantially parallel projected in a plane, wherein the identification points are measured only along a first direction, wherein the new décor is applied such that a substantially constant gap between the existing décor and the new décor is defined along a second direction orthogonal to the first direction.

2. The decoration method according to claim 1, wherein the identification points comprise one or more of at least one starting point or at least one ending point of the existing décor.

3. The decoration method according to claim 1, wherein the identification points are measured along two directions.

4. The decoration method according to claim 1, wherein the existing décor and the new décor comprise neighboring borders that are one or more of non-rectilinear or non-parallel, and in that wherein the identification points are measured along the border of the existing décor.

5. The decoration method according to claim 1, wherein the existing décor and the new décor comprise several discontinuous sections.

6. The decoration method according to claim 5, wherein the identification points comprise one or more of at least one starting point or at least one ending point for each of the discontinuous sections of the existing décor.

7. The decoration method according to claim 1, wherein the identification points comprise at least a starting point of the existing décor and an ending point of the existing décor.

8. A method comprising:

measuring identification points of a first portion of a multi-part décor on a surface of an object, the multi-part décor formed from multiple portions that includes the first portion, the identification points measured on the first portion of the multi-part décor after the first portion has been applied to the surface of the object but prior to application of at least a second portion of the multi-part décor to the surface of the object;

identifying localization points to be used for applying at least the second portion of the multi-part décor to the surface of the object, the localization points identified using information relating to the multi-part décor and the identification points that are measured; and applying at least the second portion of the multi-part décor to the surface of the object using the localization points.

9. The method of claim 8, wherein the first and second portions of the multi-part décor are adjacent to each other on the surface of the object subsequent to applying the second portion of the multi-part décor.

10. The method of claim 8, wherein a first border of the first portion of the multi-part décor and a second border of the second portion of the multi-part décor face each other and are both curved edges.

11. The method of claim 8, wherein the localization points that are identified include a starting point of the first portion of the multi-part décor and an ending point of the first portion of the multi-part décor, wherein the starting point is at a first end of the multi-part décor and the ending point is at an opposite, second end of the first portion of the multi-part décor along a linear path.

12. The method of claim 8, wherein the first portion of the multi-part décor is formed from multiple discontinuous sections, and wherein the identification points that are measured are measured for at least two locations on each of the multiple discontinuous sections of the first portion of the multi-part décor.

13. A method comprising:

measuring identification points of multiple discontinuous sections of a first portion of a multi-part décor on a surface of an object, the multi-part décor formed from multiple portions that includes the first portion, the identification points measured after the first portion has been applied to the surface of the object but prior to application of at least a second portion of the multi-part décor to the surface of the object;

identifying localization points to be used for applying at least the second portion of the multi-part décor to the surface of the object, the localization points identified using information relating to the multi-part décor and the identification points that are measured; and applying at least the second portion of the multi-part décor to the surface of the object using the localization points.

14. The method of claim 13, wherein the first and second portions of the multi-part décor are adjacent to each other on the surface of the object subsequent to applying the second portion of the multi-part décor.

15. The method of claim 13, wherein a first border of the first portion of the multi-part décor and a second border of the second portion of the multi-part décor face each other and are both curved edges.

16. The method of claim 13, wherein the localization points that are identified include a starting point of the first portion of the multi-part décor and an ending point of the first portion of the multi-part décor, wherein the starting point is at a first end of the multi-part décor and the ending point is at an opposite, second end of the first portion of the multi-part décor along a linear path.

17. The method of claim 13, wherein the identification points are measured for each of the multiple discontinuous sections of the first portion of the multi-part décor.

* * * * *